US008766117B2

(12) United States Patent
Hager

(10) Patent No.: US 8,766,117 B2
(45) Date of Patent: Jul. 1, 2014

(54) DEVICE FOR LOCKING PUSH-PULL CIRCUIT BREAKERS

(75) Inventor: Clifford Michael Hager, Fountain Inn, SC (US)

(73) Assignee: Diversified Products Group LLC., Southfield, MI (US)

( * ) Notice: Subject to any disclaimer, the term of this patent is extended or adjusted under 35 U.S.C. 154(b) by 225 days.

(21) Appl. No.: 13/565,997

(22) Filed: Aug. 3, 2012

(65) Prior Publication Data

US 2014/0034459 A1 Feb. 6, 2014

(51) Int. Cl.
*H01H 3/20* (2006.01)
*H01H 9/28* (2006.01)

(52) U.S. Cl.
CPC ..... *H01H 9/286* (2013.01)
USPC ..... 200/43.21

(58) Field of Classification Search
USPC ..... 200/43.21, 43.16, 43.18; 70/19, 211
See application file for complete search history.

(56) References Cited

U.S. PATENT DOCUMENTS

| | | | | |
|---|---|---|---|---|
| 1,829,444 | A * | 10/1931 | Goebel et al. | 70/284 |
| 3,245,240 | A * | 4/1966 | De Forrest | 70/209 |
| 5,039,829 | A * | 8/1991 | Brucksch | 200/43.18 |
| 5,207,315 | A * | 5/1993 | Benda | 200/43.11 |
| 7,977,590 | B2 * | 7/2011 | Brojanac | 200/43.14 |

* cited by examiner

*Primary Examiner* — Vanessa Girardi
(74) *Attorney, Agent, or Firm* — Robers Mlotkowski Safran & Cole P.C.

(57) ABSTRACT

An improved circuit breaker locking device is provided that is capable of locking any one of a set of push-pull circuit breaker actuators having shaft and top annular flanges of different diameters. The device includes a pair of opposing body sections, each having a proximal and a distal recess arranged in tandem, and an elastic joining member that joins the opposing body sections together. The proximal and distal recesses of the opposing body sections are sized to capture without frictionally gripping the largest diameter cylindrical shaft section and the largest annular flange of the set of actuators when the body sections are joined together around the actuator. The interface between the proximal and distal recesses is sized to interfere with and prevent passage of the smallest annular flange of all of the actuators.

20 Claims, 3 Drawing Sheets

DEVICE FOR LOCKING PUSH-PULL CIRCUIT BREAKERS

FIELD

This invention generally relates to devices for mechanically locking a circuit breaker in an open or non-current conducting position, and is specifically concerned with an improved locking device capable of securing any one of a set of circuit breakers having differently sized push-pull actuators in a "pulled out" non-current conducting position.

BACKGROUND

Circuit breakers having push-pull actuators are typically used in aircraft electrical systems. Due to the limited space and weight available on aircraft, the circuit breakers used in aircraft electrical systems should provide both a manual switching device for turning equipment on and off in order to obviate the need for separate switches for each piece of equipment as well as overcurrent protection. Accordingly, circuit breakers having a short stroke push-pull actuator that terminates in an annular flange are preferred in aircraft applications since the operator can easily close the circuit breaker into an "equipment on" position by a push-button action or open the breaker into an "equipment off" position by pulling upwardly on the annular flange on the end of the actuator. Such push-pull actuated circuit breakers can also be made compactly, which allows them to be densely arranged in the limited space provided by aircraft electrical control panels, which often must accommodate hundreds of circuit breakers.

During certain aircraft maintenance procedures, it is essential for the safety of the maintenance workers that the push-pull actuators of some of the circuit breakers remain in a pulled-out, "equipment off" position. Consequently, the prior art circuit breaker locking device 1 illustrated in FIGS. 1A and 1B was developed. This locking device 1 is designed to lock a circuit breaker 3 having a push-pull actuator 5 that is slidably mounted in a circuit board 6. The push-pull actuator 5 includes a shaft section 7 that terminates in annular flange 8. The actuator 5 is reciprocally movable with respect to the circuit board 6 and may be may be pulled up into the "circuit open/equipment off" position illustrated in FIG. 1A, or pushed down into the "circuit closed/equipment on" position illustrated in phantom in FIG. 1A.

The prior art locking device 1 is formed from a pair of mirror-symmetrical body sections 10*a*, 10*b*, each of which has a semi-cylindrical outer surface 12 and a flat inner surface 14. A semi-annular groove 16 circumscribes the semi-cylindrical outer surfaces 12 of both of the body sections 10*a*, 10*b* near the proximal ends of these components. These semi-annular grooves 16 receive a joining member 18 in the form of an elastic O-ring that pulls the two body sections 10*a*, 10*b* together in the position illustrated in FIG. 1B. As is best seen in FIG. 1A, both body sections 10*a*, 10*b* include proximal and distal semi-cylindrical recesses 20, 22 that are complementary in shape to the shaft section 7 and annular flange 8 of the push-pull actuator 5, respectively. The semi-cylindrical recesses 20, 22 connect at interface 23 shown in FIG. 1A. Each of the body sections 10*a*, 10*b* includes, at its distal end, a lever member 24 formed as shown from a 30° cut-out section. The lever members 24 of the opposing body sections 10*a*, 10*b* converge at pivot line 26 as shown. Finally, body section 10*a* includes, at the upper part of its flat inner surface 14, a protrusion 27*a* and a cavity 27*b* which interfit with a corresponding, complementary-shaped cavity 27*b* and protrusion 27*a* of the other body section 10*b*. The interfitting protrusions 27*a* and cavities 27*b* prevent the two body sections from axially sliding out of alignment when they are joined by the elastic joining member 18 in the position illustrated in FIG. 1B.

In operation, the user grasps and pulls together the lever members 24 of the opposing body sections 10*a*, 10*b* with sufficient force to overcome the elastic force applied by the resilient joining member 18. Consequently, the opposing body sections pivot apart along line 26. The resulting 60° spread of the body sections 10*a*, 10*b* allows the device 1 to receive the push-pull actuator 5 of the circuit breaker 3. When the user releases the lever members 24, the resilient joining member 18 pulls the body section 10*a*, 10*b* back together into the position illustrated in FIG. 1B such that the shaft section 7 and the annular flange 8 of the actuator 5 are respectively captured by the proximal and distal semi-cylindrical recesses 20, 22. In the past, both the diameter $D_1$ of the shaft sections 7 and the diameter $D_2$ and axial length $L_1$ of the annular flanges 8 were of standard and uniform size. Accordingly, the proximal and distal recesses 20, 22 were sized to be complementary in shape to the standard-sized shaft sections 7 and annular flanges 8 and to have corresponding diameters and $D_1'$, $D_2'$ and a length $L_1'$ that were only slightly larger than diameters and $D_1$, $D_2$ and length $L_1$. This prior art locking device 1 achieves a locking action by means of mechanical interference between the bottom surface of the annular flange 8 and the interface 23 between the proximal and distal semi-cylindrical recesses 20, 22. Such mechanical interference effectively immobilizes the actuator 5 from any axial movement and effectively locks the actuator 5 in the "circuit open/equipment off" position illustrated in FIG. 1A.

While the prior art locking device 1 works well to lock any one of a set of circuit breakers 1 having push-pull actuators 5 in which the shaft sections 7 and annular flanges 8 are all of a same size, problems arise when the radii of the shaft sections 7 and annular flanges vary. These problems have been exacerbated recently with the availability of button-like plastic collars that may be snap-fitted over the original flanges. These button-like plastic collars are available in a variety of colors, and the applicant has observed that some aircraft maintenance crews are attaching them over the original annular flanges of the circuit breakers in order to indicate, by color coding, the particular electrical system or component that the circuit breaker controls. Such plastic collars also advantageously facilitate the grasping and pulling out of the actuator into the "circuit open/equipment off" position. However, because such collars also have the effect of increasing both the radius and the thickness of the annular flange along its axis, the prior art locking device 1 may not operate to reliably lock the actuator 5 in the pulled-out, "circuit open/equipment off" position illustrated in FIG. 1A. The problems created by such plastic collars have been made worse due to the fact that they come in a variety of sizes. In cases where the largest collars are applied over the flanges 8, it may not possible to spread the body sections 10*a*, 10*b* far enough apart with the lever members 24 to allow the user to receive the flange 8 of the actuator 5 at all. And in cases where the body sections 10*a*, 10*b* can be spread far enough apart to receive the collar-enlarged flange 8, the edges of the proximal recesses 20 of the body sections 10*a*, 10*b* will simply clamp on to opposing sides of the flange 8 with the body sections 10*a*, 10*b* in a partially spread position such that a pushing force on the device may depress the actuator into a current-conducting "equipment on" position, creating a potentially unsafe condition.

SUMMARY

The most direct solution to the problem posed by variably-sized actuators would be the provision of plurality of circuit breaker locking devices designed in the same manner as the one illustrated in FIGS. 1A and 1B, but having differently-sized proximal and distal recesses capable of securely capturing actuators having shaft sections of different radii and annular flanges of both different radii and different axial lengths. However, such a solution would require the user to purchase a plurality of differently-sized locking devices and to match the proper sized locking device to every circuit breaker that requires locking, which of course would require additional material expenses and increased installation time. Moreover, as circuit breaker manufacturers are constantly providing circuit breakers with actuators and flange extension collars of different radii, such a solution would require frequent and expensive changes of tooling for the manufacturer to keep up with the changing actuator sizes.

The improved circuit breaker locking device of the invention solves or at least ameliorates all of the aforementioned problems by providing a single-sized locking device capable of securely locking the actuators having variably-sized shaft sections and annular flanges. To this end, the improved circuit breaker locking device of the invention comprises a pair of opposing body sections, each of which includes a proximal and a distal recess arranged in tandem, the proximal and distal recesses of the opposing body sections having a same axial length, and a joining member that joins the opposing body sections together with the proximal and distal recesses of the opposing body sections in axial alignment with one another, wherein the proximal and distal recesses of the opposing body sections are sized to capture without frictionally gripping the largest diameter cylindrical shaft section and the largest annular flange of all of the actuators, respectively, when the body sections are joined together over the actuator. Additionally, the proximal recesses of the opposing body sections at an axial interface between the proximal and distal recesses are sized to interfere with and prevent passage of the smallest annular flange of all of the actuators. Finally, the axial length of the distal recesses is substantially greater than an axial length of the longest annular flange of the set of actuators such that the joined body sections are slidably movable over the captured actuator at least an axial distance of substantially the axial length of the longest annular flange.

In the previously described prior art locking device, the locking action was achieved by immobilizing the annular flange of the actuator against axial movement by mechanical interference between the underside of the annular flange and the interface between the proximal and distal recesses of the body sections. By contrast, in the improved locking device, the locking action is achieved by surrounding the actuator with a mechanical envelope that prevents the actuator from being pushed down from the pulled-up position. While there can be mechanical interference the annular flange and the interface between the proximal and distal recesses, such interference now functions only to secure the body sections to the push-pull actuator so that it cannot be accidently pulled off. Unlike the prior art locking device, the improved locking device is capable of securing each one of a set of circuit breakers having push-pull actuators with differently-sized annular flanges, shaft ports and even stroke lengths with single-sized proximal and distal recesses in the opposing body sections.

DETAILED DESCRIPTION OF THE EMBODIMENT

Figure 2A:
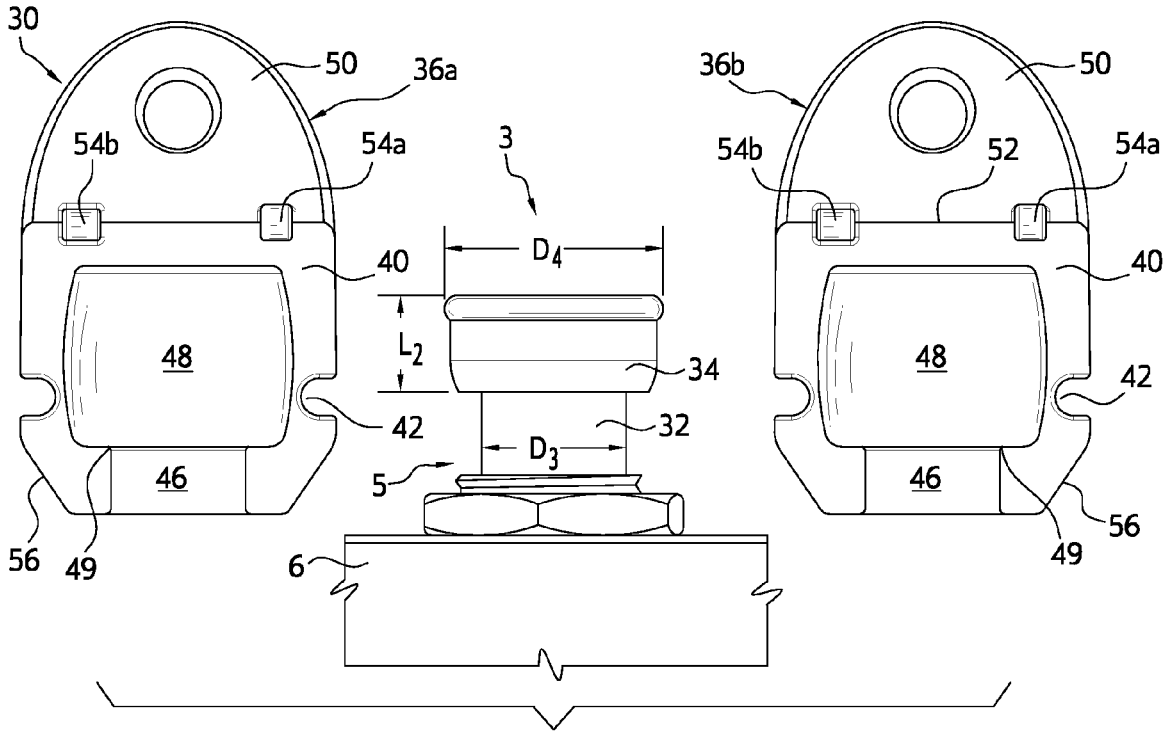
FIG. 2A is a plan view of the inner flat side of the body sections of the improved circuit breaker locking device illustrating how the interior proximal and distal recesses of the body sections are sized to contain the shaft section and annular flange of an enlarged push-pull actuator of a circuit breaker without frictional contact.
Figure 2B:
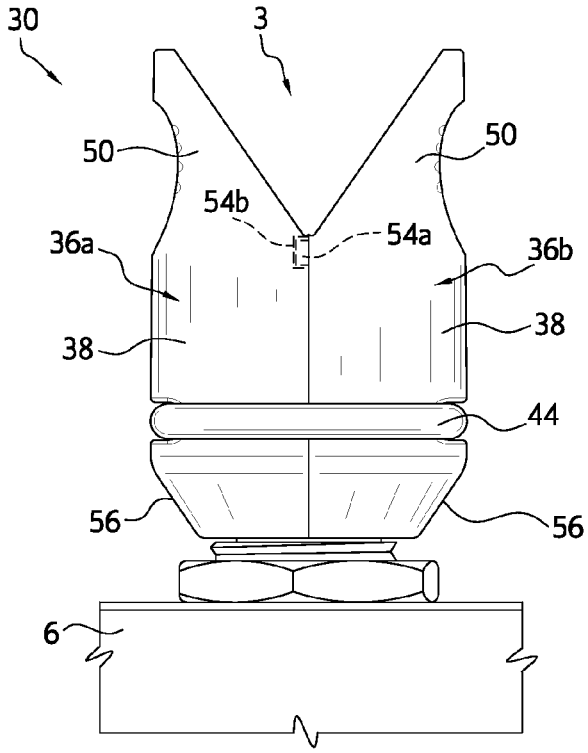
FIG. 2B is a perspective view of the body sections of the improved circuit breaker shown in FIG. 2A installed over the enlarged push-pull actuator.

With reference now to FIGS. 2A and 2B, the improved circuit breaker locking device 30 is designed to lock not only a circuit breaker 3 having an actuator 5 with a shaft section 7 an annular flange 8 of standard diameters $D_1$, $D_2$ and length $L_1$, but also a circuit breaker 3 having an actuator 5 comprising a shaft section 32 with somewhat larger diameter $D_3$ and an enlarged annular flange 34 having both a larger diameter $D_4$ and a larger axial length $L_2$. Exactly how this is accomplished is explained hereinafter.

Figure 1A:
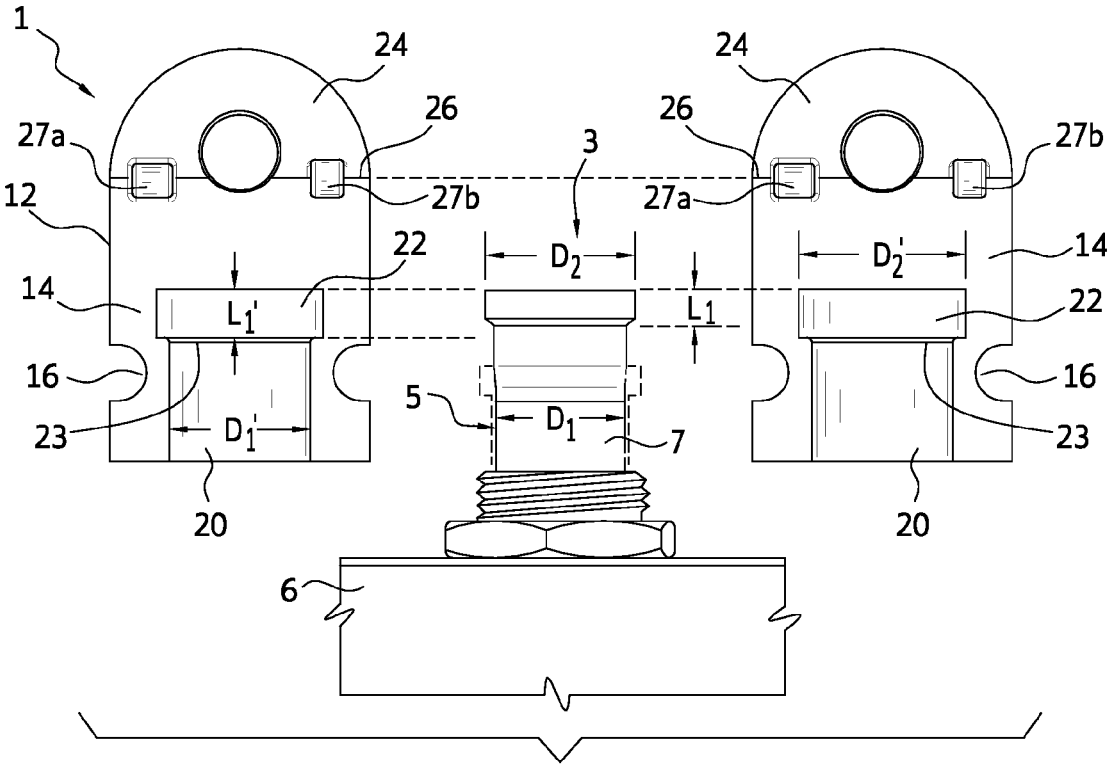
FIG. 1A (PRIOR ART)
FIG. 1A is a plan view of the inner flat side of the body sections of a prior art circuit breaker locking device illustrating how the interior proximal and distal recesses of the body sections are made to be complementary in shape to the shaft section and annular flange of a standard push-pull actuator of a circuit breaker.

Similar to the previously described locking device 1, the improved locking device 30 is formed from a pair of mirror-symmetrical body sections 36*a*, 36*b*, each of which has a semi-cylindrical outer surface 38 and a flat inner surface 40. A semi-annular groove 42 circumscribes the semi-cylindrical outer surfaces 38 of both of the body sections 36*a*, 36*b* near the proximal ends of these components. These semi-annular grooves 42 receive a joining member 44 in the form of an elastic O-ring that pulls the two body sections 36*a*, 36*b* together in the position illustrated in FIG. 2B. As is best seen in FIG. 2A, both body sections 10*a*, 10*b* include proximal and distal semi-cylindrical recesses 46, 48. However, in contrast to the prior art locking device 1, the proximal and distal semi-cylindrical recesses 46, 48 are not complementary in shape to the shaft section 7 and annular flange 8 of either the standard-size the push-pull actuator 5 shown in FIG. 1A or the enlarged push-pull actuator 5 shown in FIG. 2A, or any actuator 5 in between such sizes. Further in contrast to the prior art locking device 1, in this preferred embodiment 30, the axial length of the distal recess 48 of each of the body sections 36*a*, 36*b* is longer than the axial length of the proximal recess 46 due to the fundamentally different locking action of the improved locking device 30.

Figure 1B:
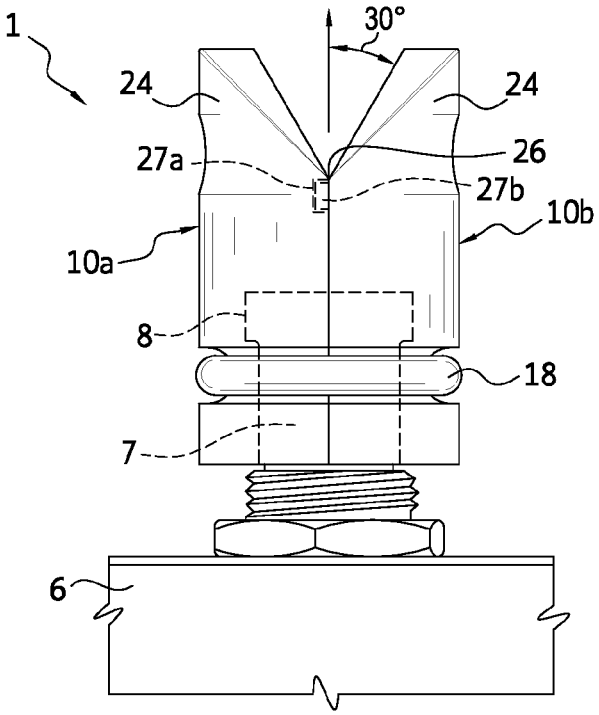
FIG. 1B (PRIOR ART)
FIG. 1B is a perspective view of the body sections of the prior art circuit breaker shown in FIG. 1A installed over the push-pull actuator.

Each of the body sections 36*a*, 36*b* of the improved locking device 30 includes, at its distal end, a lever member 50 formed as shown from a 30° cut-out section. The lever members 50 of the opposing body sections 10*a*, 10*b* converge at pivot line 52 as shown. In contrast to the prior art locking device 1, the axial length of the lever members 50 is at least one-third of the axial length of their respective body sections 36*a*, 36*b*. Body section 36*a* includes, at the upper part of its flat inner surface 40, both a protrusion 54*a* and a cavity 54*b* which interfit with a corresponding, complementary-shaped cavity 54*b* and protrusion 54*a* of the other body section 36*b*. The interfitting protrusions 27*a* and cavities 27*b* prevent the two body sections from axially sliding out of alignment when they are joined by the elastic joining member 44 in the position illustrated in FIG. 1B. Finally, each of the body sections 36*a*, 36*b* of the improved locking device 30 includes, at its proximal end, a frusto-conical section 56*a*, 56*b* as shown. The provision of frusto-conical sections 56*a*, 56*b* reduces the amount of plastic material necessary to form the body sections 36*a*, 36*b* and reduces the possibility of mechanical interference between the improved locking device 30 and components on the circuit board 6 when the device 30 is installed over the actuator 5 of a circuit breaker 3.

In operation, the user grasps and pulls together the lever members 50 of the opposing body sections 36*a*, 36*b* with sufficient force to overcome the elastic force applied by the resilient joining member 44. Consequently, the opposing body sections 36*a*, 36*b* pivot apart along line 52. The longer, at least one-third of the overall axial length of the lever members 50 increases the leverage of the user, thereby reducing the amount of compressive force the user needs to apply to the levers 50 to open distal end of the device 30 to receive an actuator 5. When the user releases the lever members 50 over a selected actuator 5, the resilient joining member 44 pulls the body sections 36*a*, 36*b* back together into the position illustrated in FIG. 2B such that the enlarged shaft section 32 and the enlarged annular flange 34 of the actuator 5 are respectively captured by the proximal and distal semi-cylindrical recesses 46, 48.

Figure 3:
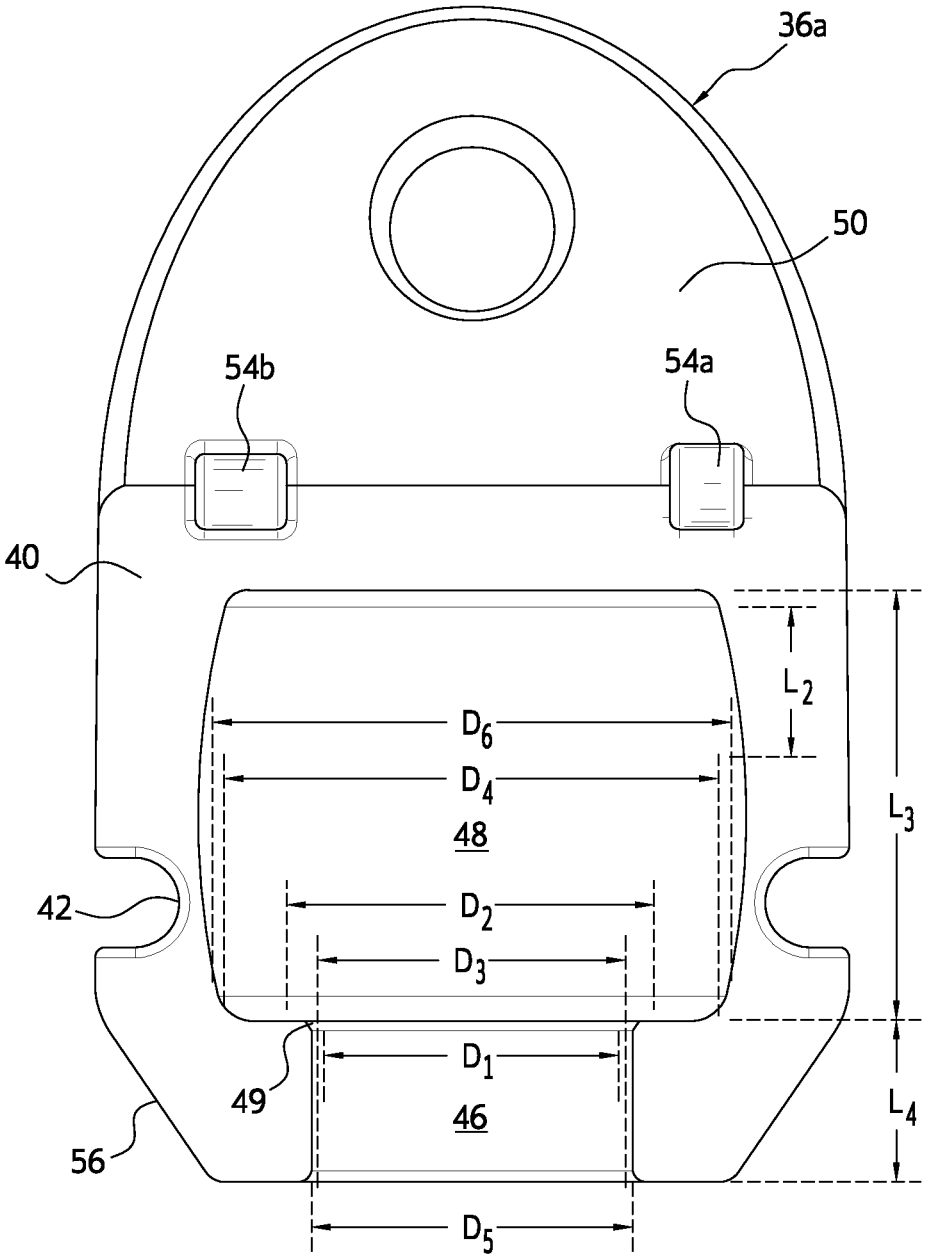
FIG. 3 is an enlarged plan view of the inner flat side of one of the body sections of the improved circuit breaker locking device illustrating in phantom how the interior proximal and distal recesses are sized to contain broad range of actuator sizes.

FIG. 3 illustrates the manner in which the proximal and distal recesses 46, 48 are sized relative to the largest and smallest actuators 5 of a set of actuators 5 on a circuit board 6 in order to achieve a positive locking action on each one of the set of variably-sized actuators 5. For the purposes of this description, it shall be assumed that the actuator 5 illustrated in FIG. 1A has the smallest-diametered shaft section 7 and annular flange 8, and that the annular flange 8 has the shortest axial length $L_1$ of all of the set of actuators. It shall further be assumed that the actuator 5 illustrated in FIG. 2A has the largest-diametered shaft section 32 and annular flange 34, and that the annular flange 34 has the longest axial length $L_2$ of all of the set of actuators. In such a case, the inner diameter $D_5$ of the proximal recess 46 is sized to be slightly larger than the outer diameter $D_3$ of the largest-diametered annular flange 34, and smaller than the outer diameter $D_2$ of the smallest-diametered annular flange 8. Additionally, the inner diameter $D_6$ of the distal recess 48 is sized to be slightly larger than the outer diameter $D_4$ of the largest-diametered annular flange 34. Additionally, the axial length $L_3$ of the distal recess 48 is substantially longer than the length $L_2$ of the annular flange 34. In fact, it is preferred that the axial length $L_3$ of the distal chamber 48 be two or more times longer than the axial length $L_4$ of the proximal recess 46.

In the previously described prior art locking device, the locking action was achieved by immobilizing the annular flange 8 of the actuator 5 against axial movement by mechanical interference between the underside of the annular flange 8 and the interface 23 between the proximal and distal recesses 20, 22 of the body sections 10*a*, 10*b*. By contrast, in the improved locking device, the locking action is achieved by surrounding the actuator 5 with a mechanical envelope that prevents the actuator 5 from being pushed down from the pulled-up position. So long as the relative diameters and lengths of the proximal and distal recesses 46, 48 are sized as previously described, the body sections 36*a*, 36*b* will be able to positively envelop any of the actuators 5 from the smallest to the largest. While there will be some slidable movement possible between the inner surfaces of the recesses 46, 48 and the outer surfaces of the actuator 5, such movement cannot act to depress any of the actuators into a current-conducting, "equipment on" position since the diameters of the recesses 46, 48 are larger than the corresponding diameters of even the largest actuator and hence cannot significantly frictionally engage any of the actuators 5. Moreover, the fact that the diameter of the proximal recess $D_5$ is smaller than the smallest-diametered annular flange 8 makes it impossible for the locking device to slip off of the end of even the smallest-diametered actuator 5 due to mechanical interference between the annular flange 8 and the interface 49 between the proximal and distal recesses 46, 48. Unlike the prior art locking device 1, the improved locking device 30 is capable of securing each one of a set of circuit breakers 3 having push-pull actuators 5 with differently-sized annular flanges 8, 34, shaft sections 7, 32 and even stroke lengths with single-sized proximal and distal recesses 46, 48 in the opposing body sections 36*a*, 36*b*.

While the invention has been described in detail with particular reference to certain preferred embodiments thereof, it will be understood that variations and modifications can be effected within the spirit and scope of the invention, which is limited only by the appended claims and equivalents thereof.

The invention claimed is:

1. A device for locking a push-pull actuator of a circuit breaker in a pulled-out position, wherein the actuator includes a substantially cylindrical shaft section, and an annular flange circumscribing a distal end of the cylindrical shaft section, comprising:

a pair of opposing body sections, each of which includes a proximal and a distal recess arranged in tandem, and a joining member that joins the opposing body sections together with the proximal and distal recesses of the opposing body sections in axial alignment with one another, wherein the proximal recesses of the opposing body sections capture the cylindrical shaft section of the actuator without frictional engagement and the distal recesses of the opposing body sections capture the annular flange of the actuator without frictional engagement when the body sections are joined together around the actuator by the joining member, and an axial interface between the proximal and distal recesses interferes with and prevents passage of the annular flange from the distal to the proximal recesses, and an axial length of the distal recesses exceeds an axial length of the captured annular flange such that the joined body sections are slidably movable over the captured actuator an axial distance corresponding to a portion of the axial length of the annular flange.

2. The improved device of claim 1, wherein the axial length of the distal recesses is the same or greater than an axial length of the proximal recesses.

3. The improved device of claim 1, wherein each of the pair of opposing body sections has a proximal portion that includes the proximal and distal recesses, and a distal portion that includes a lever member for spreading the proximal portions of the opposing body sections apart when the lever members of the opposing body sections are pushed toward one another, and an axial length of the lever members of the pair of opposing body sections is at least one-third of an axial length of the pair of opposing body sections.

4. The device of claim 1, wherein an exterior portion of the proximal ends of the opposing body sections is tapered.

5. The device of claim 4, wherein the exterior portion of proximal ends of the opposing body sections are semi frusto-conically shaped.

6. A locking device for selectively locking individual push-pull actuators, within a set of circuit breakers, in a pulled-out position, where the actuators each comprise a substantially cylindrical shaft section, and an annular flange circumscribing a distal end of the cylindrical shaft section, where the shaft sections and annular flanges of different actuators may have different diameters and lengths;

the locking device comprising:

a pair of opposing body sections, each of which includes a proximal and a distal recess arranged in tandem and having a combined axial length the same or greater than the combined length of the shaft section and annular flange of the actuator, the proximal and distal recesses of one body section having a same axial length respectively of the proximal and distal recesses of the other body section, and a joining member that joins the opposing body sections together with the proximal and distal recesses of the opposing body sections in axial alignment with one another, wherein the proximal and distal recesses of the opposing body sections are sized to capture without frictionally gripping the cylindrical shaft section and the annular flange of the actuator, respectively, when the body sections are joined together over the actuator, the proximal recesses of the opposing body sections, at an axial interface between the proximal and distal recesses, are sized to interfere with and prevent passage of the annular flange of the actuator in an axial direction, and wherein an axial length of the distal recesses exceeds an axial length of the annular flange within the set of actuators such that the joined body sections are slidably movable over the captured actuator an axial distance corresponding to a portion of the axial length of the annular flange.

7. The system of claim 6, wherein axial length of the distal recesses is the same or greater than an axial length of the proximal recesses.

8. The device of claim 6, wherein the proximal and distal recesses of the pair of opposing body sections are substantially semi-cylindrical.

9. The device of claim 8, wherein the radii of the proximal semi-cylindrical recesses are larger than the radius of the cylindrical shaft section of the actuators and smaller than the radius of the annular flange, such that inner surfaces of the proximal recesses freely slide over outer surfaces of the cylindrical shaft section of the actuators, and the radii of the distal substantially semi-cylindrical recesses are larger than the radius of the annular flange of the actuators of the set of circuit breakers such that inner surfaces of the distal recesses freely slide over outer surfaces of the annular flange of the actuators.

10. The device of claim 6, wherein the proximal and distal recesses of the pair of opposing body sections are mirror symmetrical to one another.

11. The device of claim 6, wherein an exterior portion of the proximal ends of the pair of opposing body sections is tapered.

12. The device of claim 11, wherein the exterior portions of the proximal ends of the pair of opposing body sections are semi frusto-conically shaped.

13. The device of claim 6, wherein the joining member is an elastic band that circumscribes and resiliently joins the pair of opposing body sections together.

14. The device of claim 6, wherein the joining member engages the pair of opposing body sections in mutual contact together.

15. The device of claim 6, wherein each of the pair of opposing body sections has a proximal portion that includes the proximal and distal recesses, and a distal portion that includes a lever member for spreading the proximal portions of the opposing body sections apart when the lever members of the opposing body sections are pushed toward one another, and an axial length of the lever members of the pair of opposing body sections is at least one-third of an axial length of the pair of opposing body sections.

16. A system for locking push-pull actuators, within a set of circuit breakers, in a pulled-out position, where each of the actuators comprise a substantially cylindrical shaft section, and an annular flange circumscribing a distal end of the cylindrical shaft section, where the shaft sections and annular flanges of different actuators may have different diameters and lengths, such that the system includes a locking device comprising:

a pair of opposing body sections, each of which includes proximal and distal recesses, the proximal and distal recesses of one body section being mirror-symmetrical to the proximal and distal recesses of the other body section, and a joining member that resiliently joins the opposing body sections together such that the proximal and distal recesses of one body section are in mirror-symmetrical alignment with the proximal and distal recesses of the other body section, wherein the proximal and distal recesses of the opposing body sections are sized to capture without frictionally gripping the cylindrical shaft section and the annular flange of the actuator, when the body sections are joined together over the actuator, and wherein an axial interface, between the proximal and distal recesses, is sized to interfere with and prevent passage of the annular flange of the actuator from the distal recesses to the proximal recesses, and wherein an axial length of the distal recesses exceeds an axial length of the annular flange such that the joined body sections are slidably movable over the captured actuator an axial distance corresponding to a portion of the axial length of the annular flange.

17. The system of claim 16, wherein the proximal and distal recesses of the pair of opposing body sections are substantially semi-cylindrical, and wherein the radii of the proximal semi-cylindrical recesses are larger than the radius of the cylindrical shaft section of the actuators within the set of circuit breakers and smaller than the radius of the annular flange, such that inner surfaces of the proximal recesses freely slide over outer surfaces of the cylindrical shaft section, and the radii of the distal substantially semi-cylindrical recesses are larger than the radius of the annular flange of the actuator within the set of circuit breakers, such that inner surfaces of the distal recesses freely slide over outer surfaces of the annular flange.

18. The system of claim 16, wherein the joining member includes an elastic band, and wherein the pair of opposing body sections each include a circumferential groove that receives the elastic band.

19. The system of claim 18, wherein each of the pair of opposing body sections has a proximal portion that includes the proximal and distal recesses, and a distal portion that includes a lever member for spreading the proximal portions of the opposing body sections apart when the lever members of the opposing body sections are pushed toward one another.

20. The system of claim 19, wherein an axial length of the lever members of the pair of opposing body sections is at least one-third of an axial length of the pair of opposing body sections.

* * * * *